US011478673B2

(12) United States Patent
Liu

(10) Patent No.: US 11,478,673 B2
(45) Date of Patent: Oct. 25, 2022

(54) WALKING FLAT BELT HAVING HANGING EXERCISE MEANS

(71) Applicant: Jiangsu Huari Webbing Leather Co., Ltd., Taizhou (CN)

(72) Inventor: Zhaogen Liu, Taizhou (CN)

(73) Assignee: JIANGSU HUARI WEBBING LEATHER CO., LTD., Taizhou (CN)

( * ) Notice: Subject to any disclaimer, the term of this patent is extended or adjusted under 35 U.S.C. 154(b) by 28 days.

(21) Appl. No.: 16/826,225

(22) Filed: Mar. 21, 2020

(65) Prior Publication Data

US 2020/0298041 A1 Sep. 24, 2020

(30) Foreign Application Priority Data

Mar. 22, 2019 (CN) ..... 201920369950.X

(51) Int. Cl.

| | |
|---|---|
| ***A63B 7/02*** | (2006.01) |
| ***A63B 17/04*** | (2006.01) |
| ***A63B 21/00*** | (2006.01) |
| ***A63B 7/08*** | (2006.01) |

(52) U.S. Cl.

CPC ..... *A63B 7/02* (2013.01); *A63B 7/085* (2013.01); *A63B 17/04* (2013.01); *A63B 21/4035* (2015.10); *A63B 2208/029* (2013.01)

(58) Field of Classification Search

CPC ..... A63B 7/00–085; A63B 9/00–2009/008; A63B 27/00–04; A63B 2209/10; A63B 21/068; A63B 21/16; A63G 31/00–16

See application file for complete search history.

(56) References Cited

U.S. PATENT DOCUMENTS

| | | | | |
|---|---|---|---|---|
| 10,653,115 | B2 * | 5/2020 | Mowlds | A63F 9/0601 |
| 10,994,167 | B1 * | 5/2021 | Ferreira | A63B 7/02 |
| 2017/0319887 | A1 * | 11/2017 | O'Brien | A63B 7/02 |
| 2018/0185690 | A1 * | 7/2018 | Coulter | A63B 7/02 |

OTHER PUBLICATIONS

SportsTrail Amazon document (derived from: SportsTrail Store, Ninja Warrior Obstacle Course . . . [online], Amazon, Feb. 19, 2018 [retrieved on May 5, 2021], Retrieved from: continued below in spaces V and W (Year: 2018).*
https://www.amazon.com/SportsTrail-Title/dp/B079WWTYWD/ref=asc_df_B079WWTYWD/?tag=hyprod-20&linkCode=df0&hvadid=312123657341&hvpos=&hvnetw=g&hvrand=8594677945962242409&hvpone=&hvptwo=&hvqmt=&hvdev=c&hvdvcmdl=&hvlocint=&hvlocphy=9008148&hvtargid=pla-573612755972&psc=1&tag=&ref=&adgrpid=(Year: 2018).*
60656852805&hvpone=&hvptwo=&hvadid=312123657341&hvpos=&hvnetw=g&hvrand=8594677945962242409&hvqmt=&hvdev=c&hvdvcmdl=&hvlocint=&hvlocphy=9008148&hvtargid=pla-573612759972 (Year: 2018).*

* cited by examiner

*Primary Examiner* — Jennifer Robertson
*Assistant Examiner* — Catrina A Letterman
(74) *Attorney, Agent, or Firm* — Treasure IP Group, LLC

(57) ABSTRACT

The present application provides a walking flat belt with a hanging exercise means. The present invention uses a buckle flat belt to form a plurality of installation positions. The buckle flat belt is installed on the flat belt body through a "日" shaped buckle. The plurality installation positions of the buckles on the walking flat belt can be adjusted. The user can adjust the distance between two adjacent snaps flat belts according to his own needs, so that the user can freely choose the distance between the hanging objects to meet the needs of the user, to achieve the purpose of exercise.

8 Claims, 17 Drawing Sheets

Prior art

WALKING FLAT BELT HAVING HANGING EXERCISE MEANS

CROSS REFERENCE TO RELATED APPLICATION

This application claims priority to a Chinese Application No. CN 201920369950X, filed on Mar. 22, 2020. The Chinese Application is incorporated herein by reference in its entirety.

TECHNICAL FIELD

The present invention relates to the technical field of medical equipment, in particular to a walking flat belt with a hanging exercise means.

BACKGROUND TECHNIQUE

Outdoor development sports are also called experiential training. With the development of the society, outdoor development sports have attracted more and more attention, and increasingly become the focus of attention. Outdoor development sports are highly involved, suitable for all ages, and flat belts are used in outdoor development sports. One of the popular and representative equipment, as shown in FIG. 1, one end of the sling body 11 is fastened to a fixed object such as a tree pole, and the other end of the sling body 11 is tightened with a mounting member 12 to another fixed object such as another vertical pole. The length of the sling body 11 can be within a certain range. Inside, the sling body 11 is tightened by the mounting member 12 to prevent the sling body 11 from slackening. The sling body 11 is provided with a plurality of mounting positions, and each mounting position is to sew the two ends of a second small flat strap 14 in the sling body 11 when the sling body 11 is made, and then the connecting piece is installed on the mounting position, and then, hanging objects such as the hanging ring are installed on the connecting piece configured to be used for exercise. However, since the installation position is fixed, it is impossible for the user to adjust the installation position according to his or her own needs, so that the user cannot freely choose the distance between the hanging objects to suit the user's exercise purpose.

SUMMARY OF THE INVENTION

In order to solve the problems existing in the prior art, the present invention provides a walking flat belt with a hanging exercise means, which has the characteristics of adjustable buckle positioning so that a user can adjust distance between the two buckles to fit for his need.

The technical solution of the present invention to solve the above problems is: a walking flat belt with a hanging exercise means, including a mounting member, a flat belt body, an obstacle and a connecting member;

The mounting member include a "日" shaped buckle and a buckle flat belt. The "日" shaped buckle is consisting of a mouthpiece element and a partition element. The partition element is located in the mouthpiece element. The two ends of the partition element are connected to the mouthpiece element and the area the mouthpiece element enclosed is divided into two parts. They are the first connection area and the second connection area. In one embodiment, the mouth piece element is rectangular in shape having a pair of horizontal members and a pair of vertical members, in one example, two ends of the partition element is connected to the vertical members across from each other and the vertical members are shorter than the horizontal members.

One end of the buckle flat belt passes through the first connection area, in turn, passes through the partition element and then passes through the second connection area, and is connected with the other end.

Further, the flat belt body is provided with a plurality of mounting members; one end of the flat belt body passes through the first connection area of the first mounting member, in turn, it by passes the partition element of the first mounting member and passes through the second connection area of the first mounting member.

Further, the two ends of the buckle flat belt are connected by a sewing connection, rivet connection or adhesive connection.

Further, the obstacle is suspended from the buckle flat belt through the connecting member.

Further, the obstacles are selected from rings, monkey rods, swings, monkey fists, suspension rods, ladders, climbs, and nets.

Further, the connecting member is a closed ring and can be firmly held on the mounting member.

Further, the shape of the connecting member is selected from a circle, an oval, a triangle, a rectangle, or a polygon.

Further, the connecting member is a carabiner or a hook.

The present invention has beneficial effects: the present invention uses a buckle flat belt to form a plurality of installation positions, the buckle flat belt is installed on the flat belt body through a "日" shaped buckle, and the position of the snap flat belt on the flat belt body can be adjusted; The user can adjust the distance between two adjacent buckle flat belts according to his own needs, so that the user can freely choose the distance between the hanging objects to meet the needs of the user and achieve the purpose of exercise.

Figure 1:
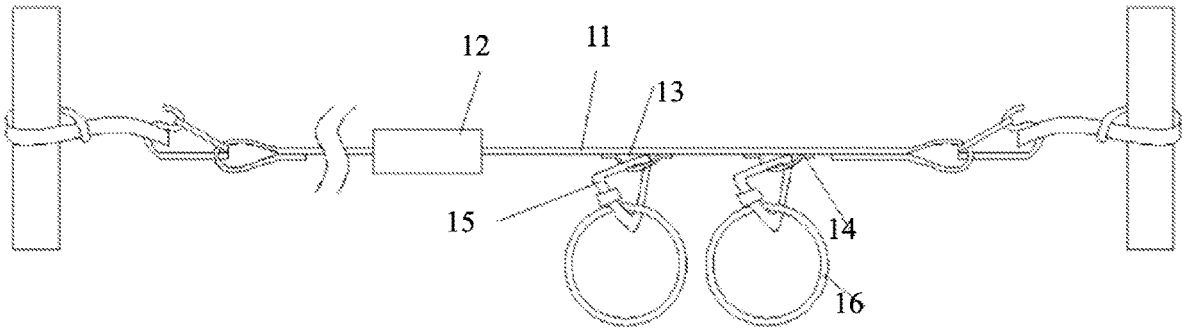
FIG. 1 shows the prior art.
Figure 2:
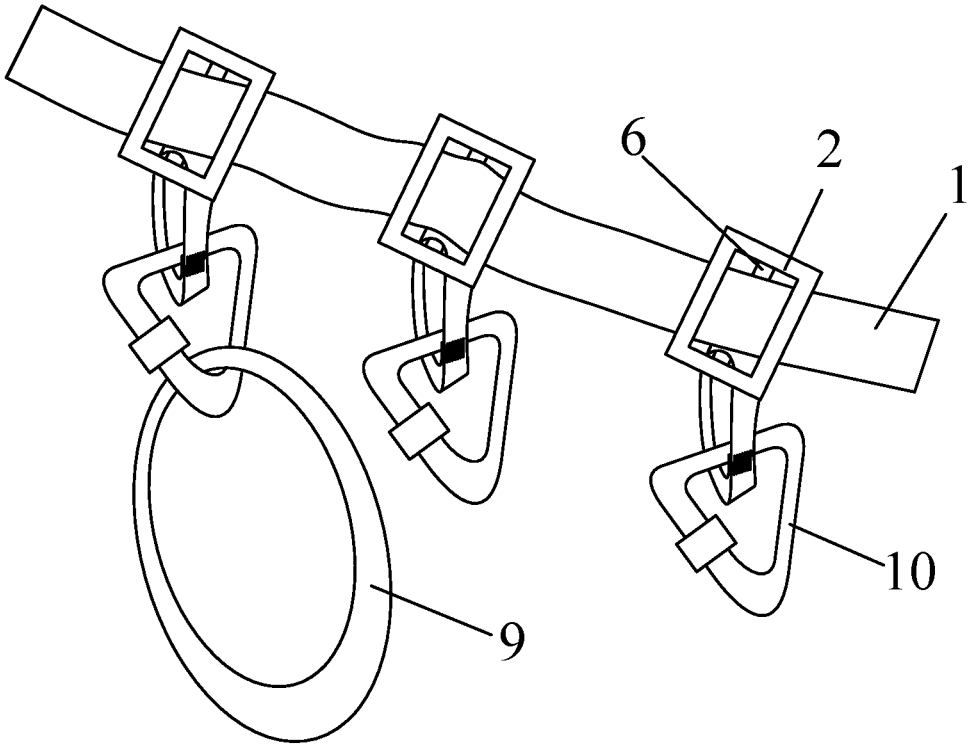
FIG. 2 is a schematic structural diagram of the present invention.
Figure 3:
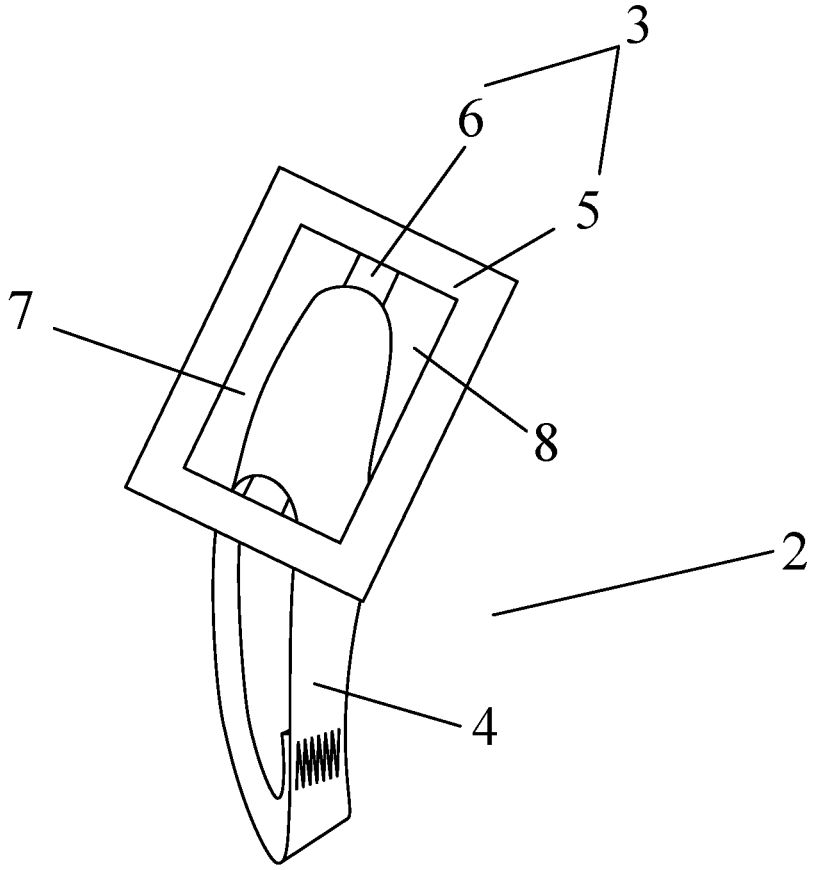
FIG. 3 is a connection diagram of the snap flat belt and the mounting member.
Figure 4:
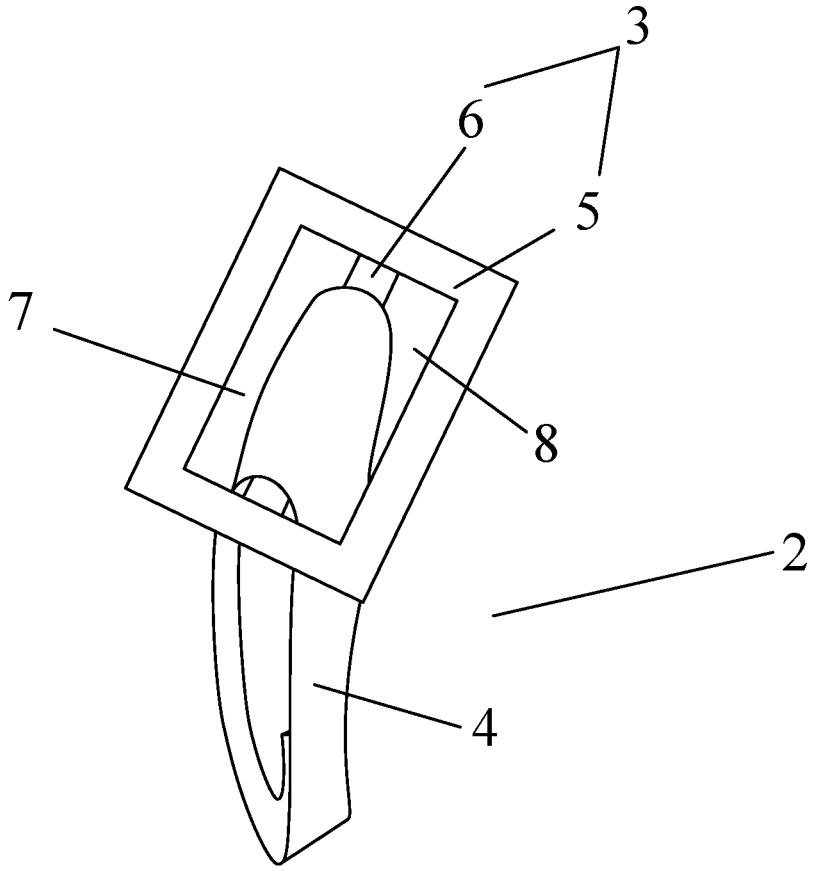
FIG. 4 is an illustration to show that both ends of the flat strap are connected an adhesive connection.
Figure 5:
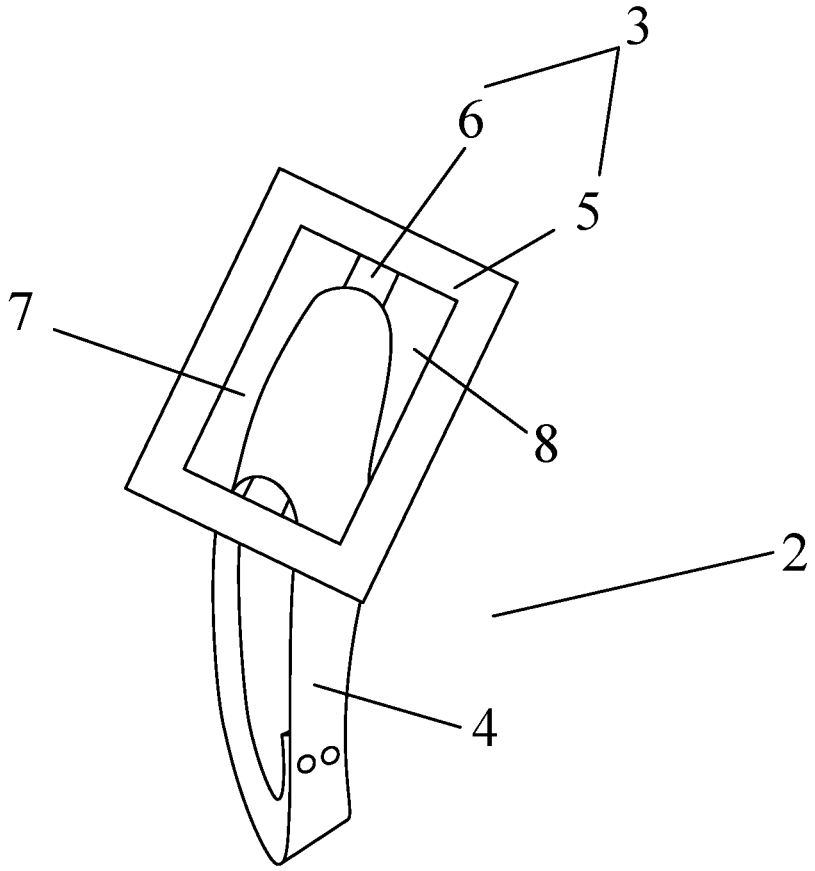
FIG. 5 is an illustration to show that both ends of the flat strap are connected a rivet connection.
Figure 6:
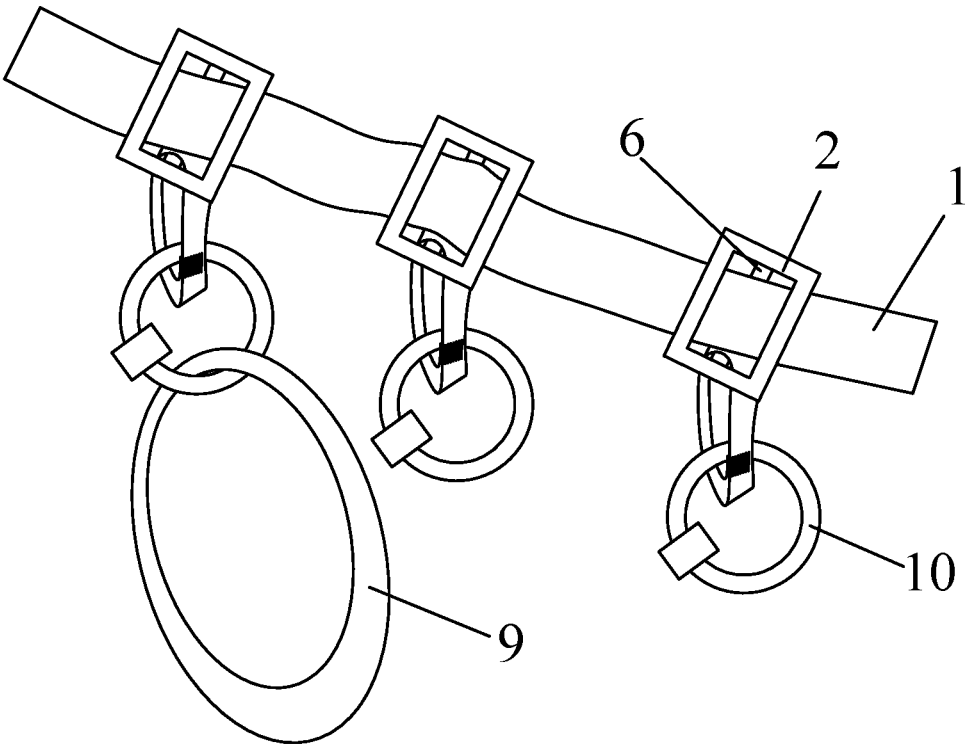
FIG. 6 is an illustration to show that the connecting member is circular shaped.
Figure 7:
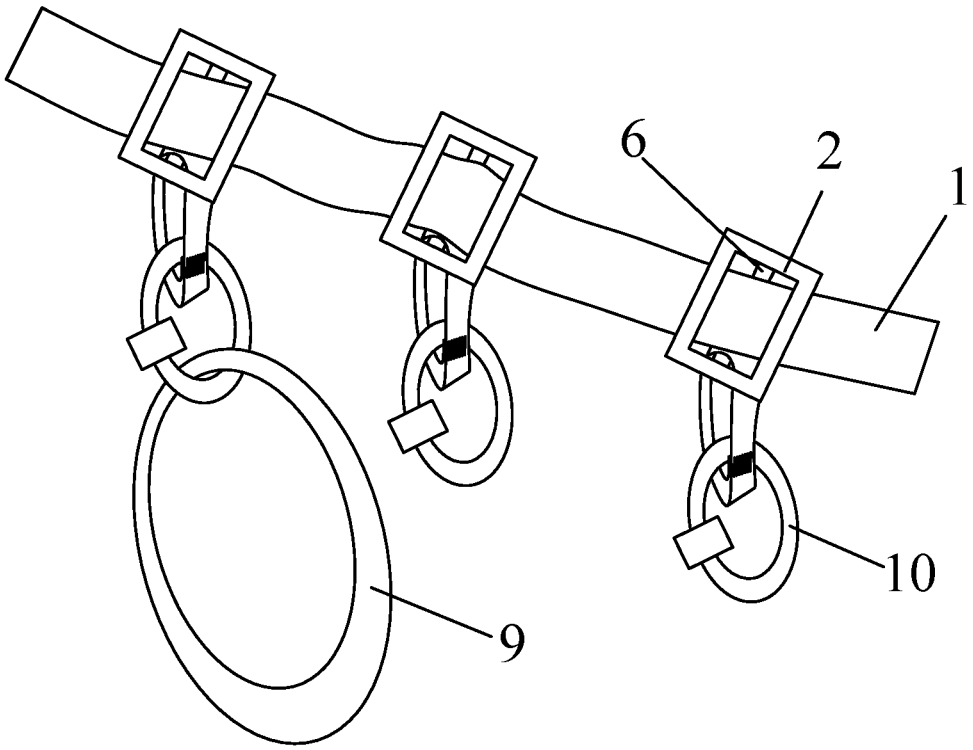
FIG. 7 is an illustration to show that the connecting member is elliptical shaped.
Figure 8:
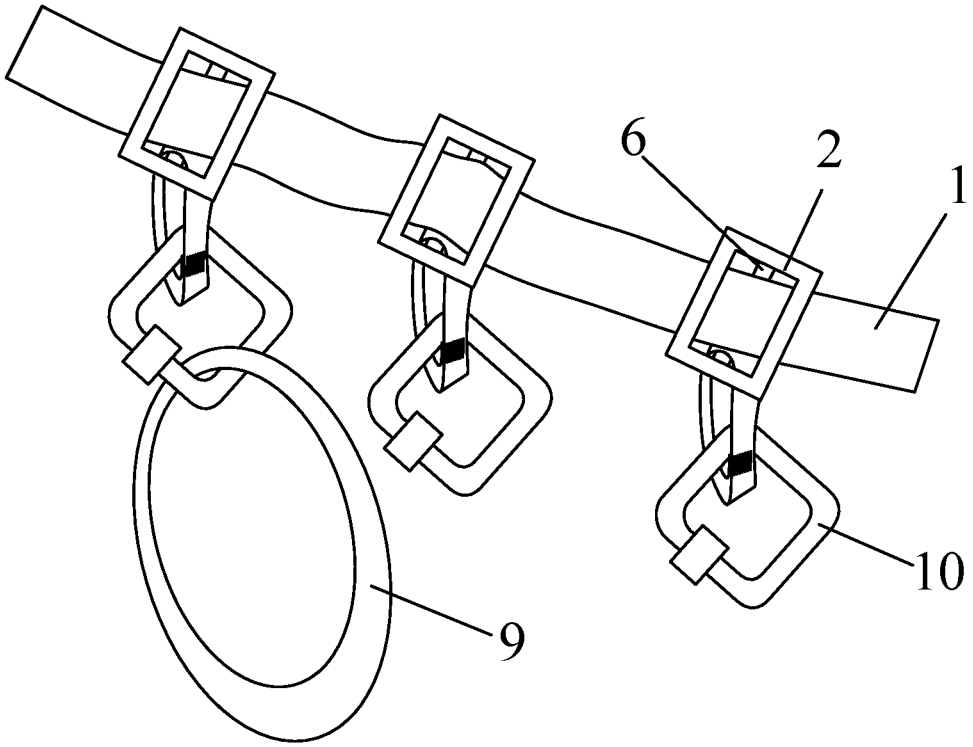
FIG. 8 is an illustration to show that the connecting member is rectangular shaped.
Figure 9:
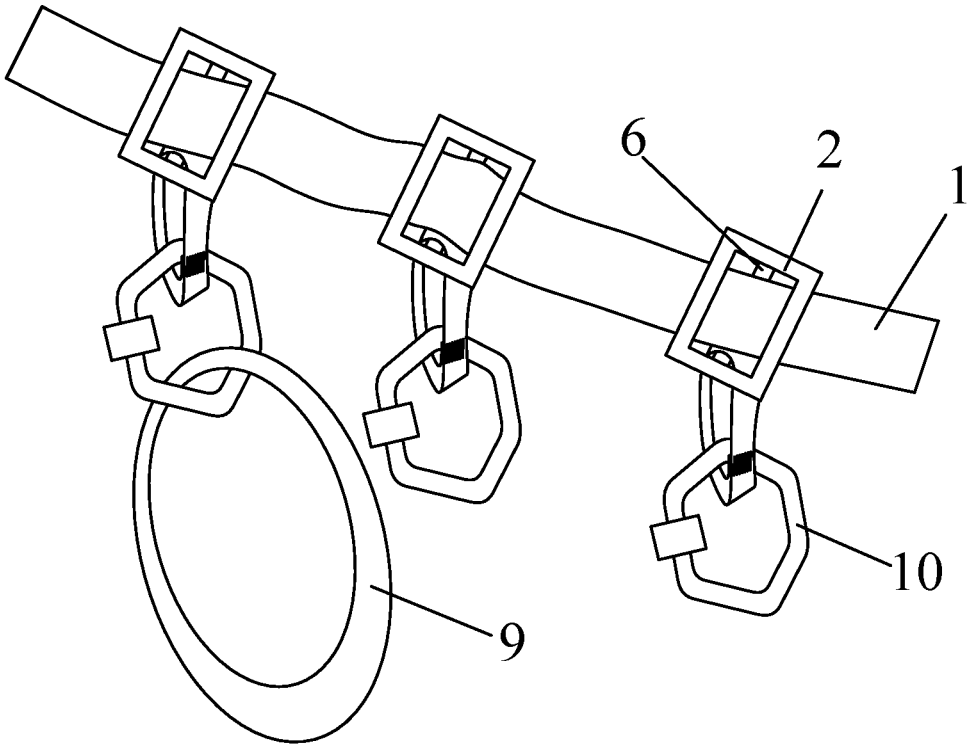
FIG. 9 is an illustration to show that the connecting member is polygonal shaped.
Figure 10:
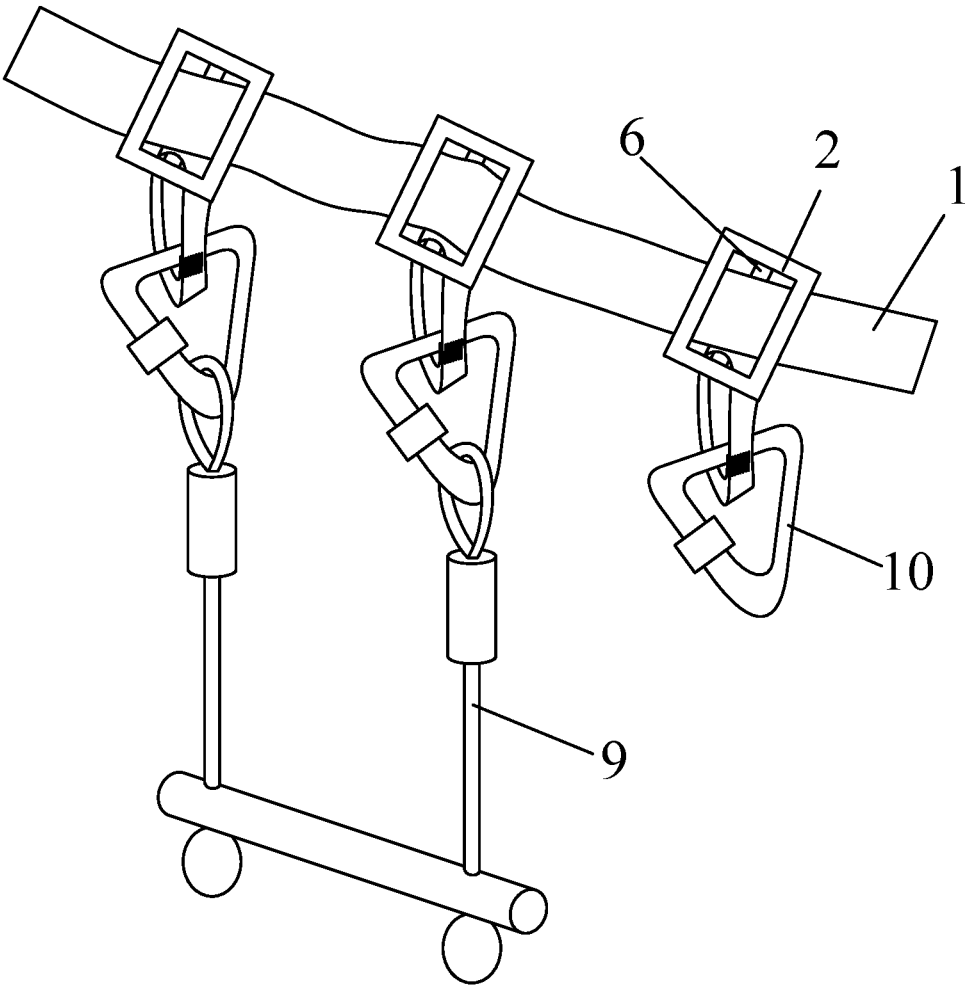
FIGS. 10-16 are illustrations to show that the obstacles can be a bail, monkey bars, swing, monkey boxing, boom, ladder, climb board, and climb net.
Figure 11:
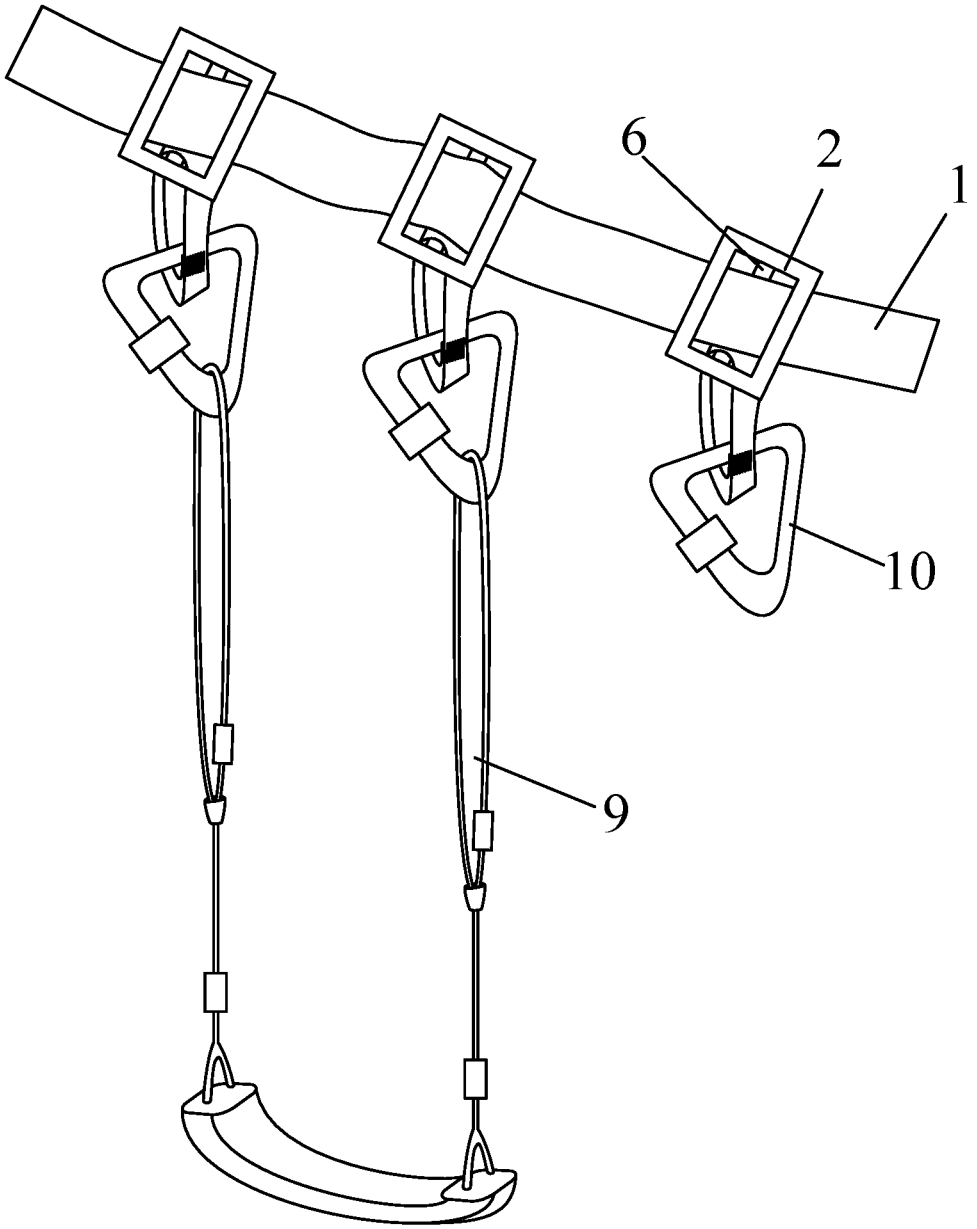
Figure 12:
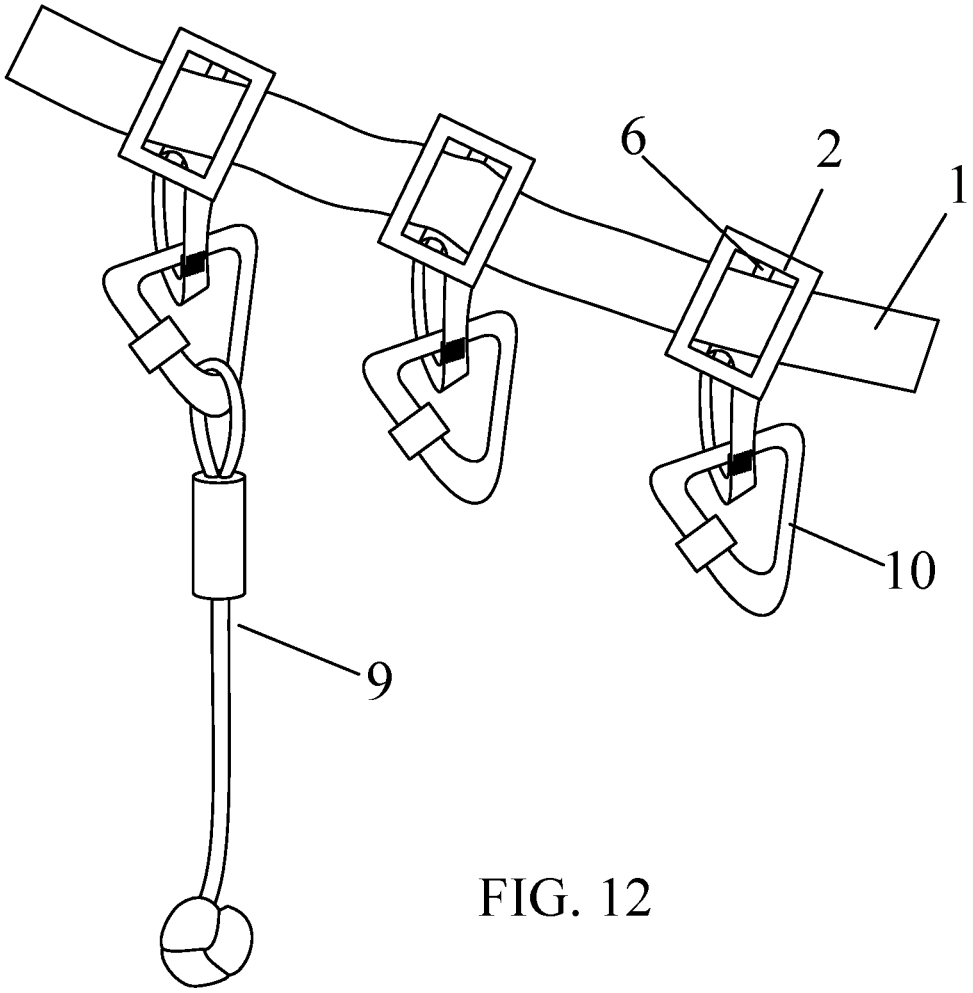
Figure 13:
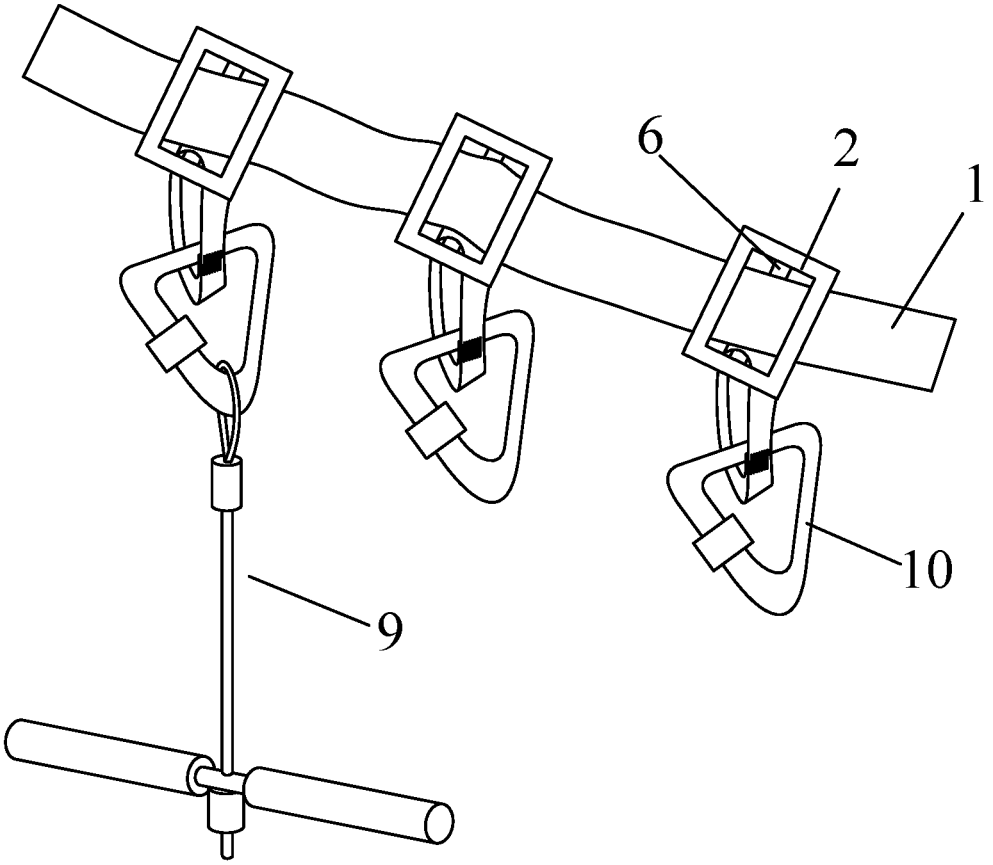
Figure 14:
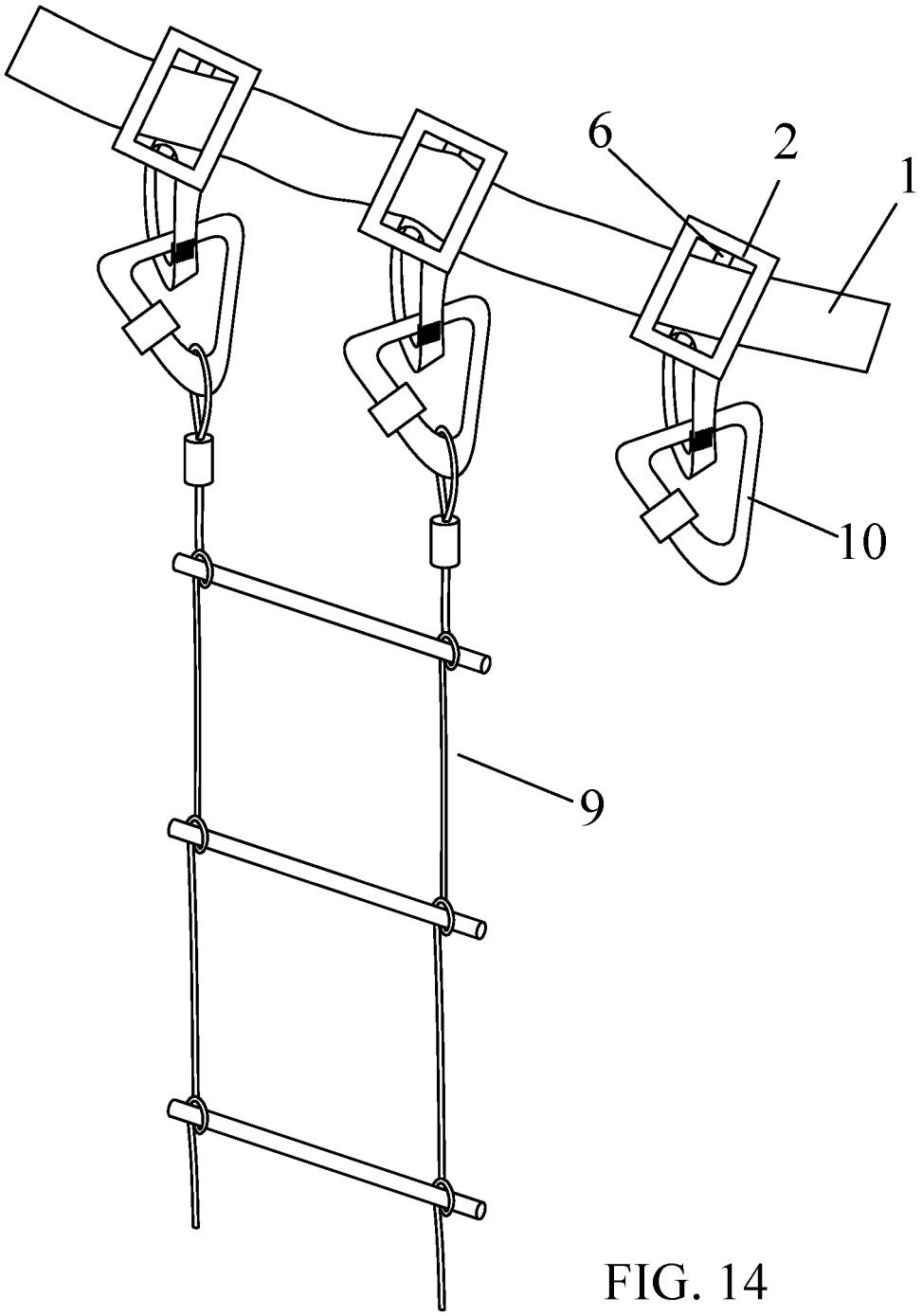
Figure 15:
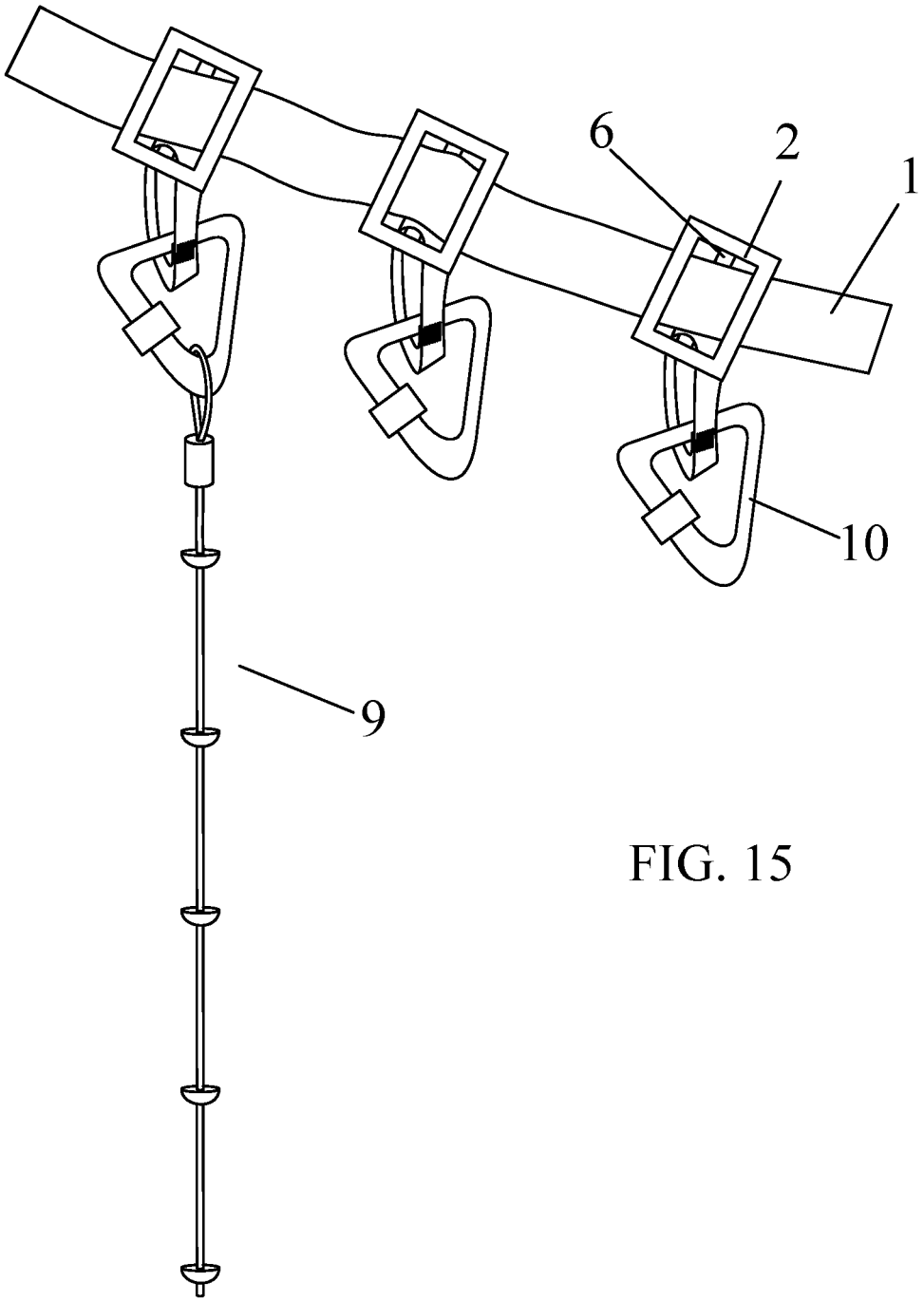
Figure 16:
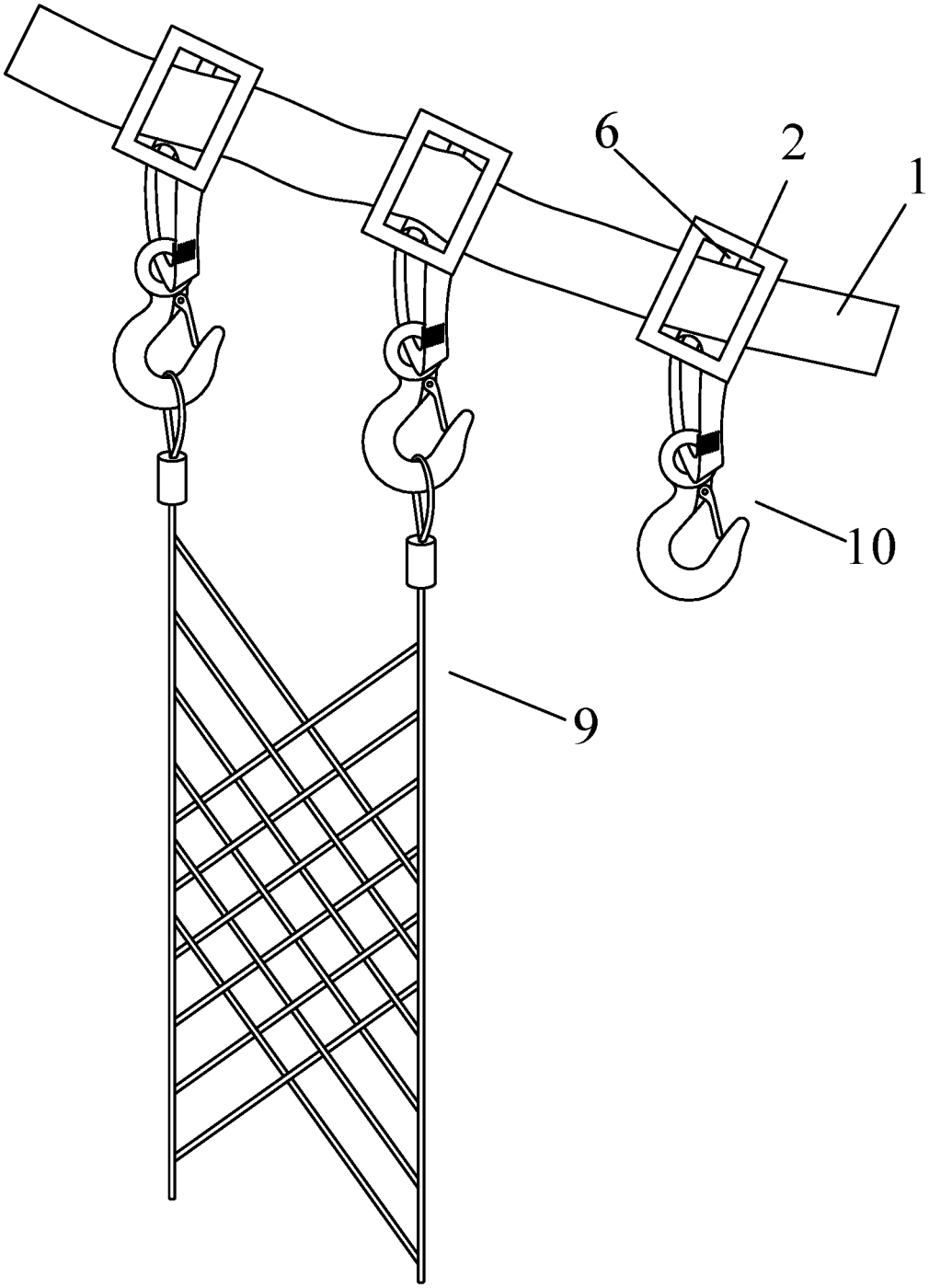
Figure 17:
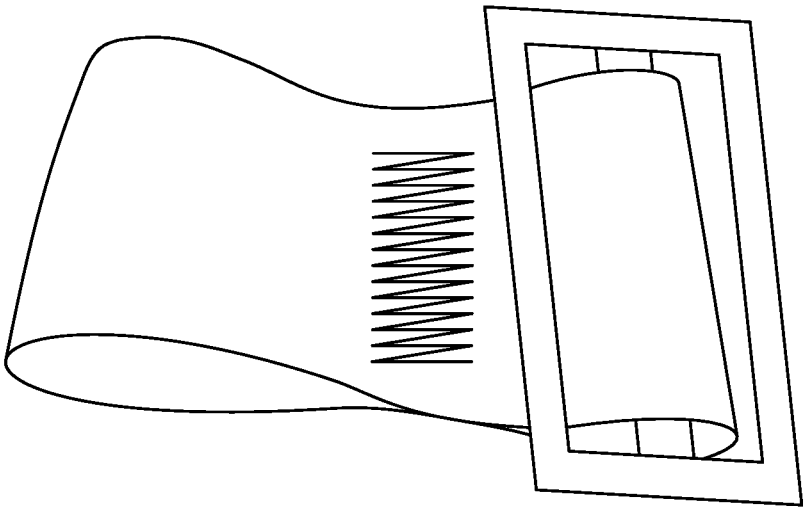
FIG. 17 is an illustration of one embodiment of the—"日" shaped buckle element and flat strap element.

In the figure: 1—sling body, 2—mounting member, 3—"日" shaped buckle, 4— flat strap, 5—mouthpiece, 6—partition, 7—first connection area, 8—second connection area, 9—obstacle, 10—connecting member.

DETAILED DESCRIPTION OF THE PREFERRED EMBODIMENTS

The following further describes the present invention with reference to the drawings and specific embodiments.

A walking flat belt with a hanging exercise means includes a mounting member 2, a sling body 1, an obstacle 9, and a connecting member 10;

The sling body 1 is provided with a plurality of mounting members 2; the mounting member 2 includes a "日" shaped buckle 3 and a buckle flat strap 4, the "日" shaped buckle 3 includes a mouthpiece 5, a partition 6, and the partition 6 is located on the mouth 5 Inside, the two ends of the partition plate 6 are integrally connected with the mouthpiece 5, and the partition plate 6 divides the mouthpiece 5 into a first connection area 7 and a second connection area 8;

One end of the buckle flat strap 4 passes through the first connection area 7, in turn, it passes the partition plate 6 and passes through the second connection area 8 and is sewn and connected with the other end; one end of the sling body 1 passes through the first connection area 7 in turn and pass by the partition plate 6 passes through the second connection area 8; the position of the buckle flat strap 4 on the sling body 1 is adjustable; the user can adjust the distance between two adjacent buckle flat strap 4 according to his or her own needs.

The obstacle 9 is suspended from the buckle flat strap 4 through the connecting member 10, and the user hangs an obstacle 9 of a different type on the buckle flat strap 4 to achieve the purpose of hanging exercise.

The obstacle 9 may be a ring, a monkey rod, a swing, a monkey boxing, a hanging rod, a ladder, a climb, a crawl, and is not limited to the above list.

The connecting piece is a closed ring and can be firmly held on the mounting piece. The shape of the connecting piece is circular, oval, triangular, rectangular, or polygonal.

The connecting piece can be a detachable carabiner or hook, and the obstacle can be easily removed from the mounting piece.

Many other changes and modifications can be made without departing from the spirit and scope of the invention. It should be understood that the present invention is not limited to specific embodiments, and the scope of the present invention is defined by the appended claims.

The invention claimed is:

1. A walking flat belt, comprising a mounting member, a sling body, a hanging obstacle, and a connecting member; wherein the mounting member is mounted to the sling body and comprises a rectangular shaped buckle and a flat strap to receive the rectangular shaped buckle;

the rectangular shaped buckle, including a mouthpiece element, made of a pair of horizontal members and a pair of vertical members and a partition element, located in the mouthpiece element; wherein two ends of the partition element are connected with the vertical members of the mouthpiece element to form one integral piece;

the partition element divides an area enclosed by the mouthpiece element to a first connection area and second connection area;

wherein one end of the flat strap passes through the first connection area, then passes over the partition element and then passes through the second connection area, and is connected with an other end of the flat strap.

2. The walking flat belt according to claim 1, characterized in that the sling body is provided with a plurality of mounting members; for each of the mounting members, one end of the sling body passes through the first connection area of a first mounting member in a sequence of the plurality of mounting members, and is wound around the partition element of the first mounting member and then passes through the second connection area of the first mounting member.

3. The walking flat belt according to claim 1, characterized in that both ends of the flat strap are connected by a sewn connection, rivet connection, or an adhesive connection.

4. The walking flat belt according to claim 1, characterized in that said obstacle is connected to the sling body of the walking flat belt, by the flat strap.

5. The walking flat belt according to claim 1 wherein the obstacle is one or more selected from a bail, monkey bars, swing, monkey boxing, boom, ladder, climb board, and climb net.

6. The walking flat belt according to claim 4, wherein said connecting member is a closed ring, configured to be firmly held on the mounting member.

7. The walking flat belt according to claim 6, wherein a shape of the connecting member is any one of circular, elliptical, triangular, rectangular, and polygonal.

8. The walking flat belt according to claim 6, wherein said connecting member is a carabiner or a hook.

* * * * *